US011060329B2

(12) United States Patent
Richards

(10) Patent No.: US 11,060,329 B2
(45) Date of Patent: Jul. 13, 2021

(54) ENHANCED OBJECT DETECTION

(71) Applicant: Ford Global Technologies, LLC, Dearborn, MI (US)

(72) Inventor: Adam J. Richards, Canton, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 263 days.

(21) Appl. No.: 16/357,501

(22) Filed: Mar. 19, 2019

(65) Prior Publication Data

US 2020/0300008 A1 Sep. 24, 2020

(51) Int. Cl.
*E05C 17/00* (2006.01)
*E05F 15/43* (2015.01)

(52) U.S. Cl.
CPC ..... *E05C 17/006* (2013.01); *E05F 15/431* (2015.01); *E05F 2015/434* (2015.01); *E05Y 2900/532* (2013.01)

(58) Field of Classification Search
CPC ..... E05C 17/006; E05F 15/431; E05F 2015/434; E05Y 2900/532
See application file for complete search history.

(56) References Cited

U.S. PATENT DOCUMENTS 9,269,263 B2 2/2016 Gieseke
9,470,034 B2 10/2016 Ihlenburg et al.
10,025,318 B2 7/2018 Srivastava
2008/0197985 A1* 8/2008 Liljeblad ..... B62D 35/001 340/425.5
2011/0215916 A1* 9/2011 Boehme ..... E05F 15/43 340/436
2013/0222592 A1* 8/2013 Gieseke ..... G08G 1/096708 348/148
2015/0300073 A1* 10/2015 Ihlenburg ..... E05F 15/40 701/49
2017/0168497 A1* 6/2017 Kim ..... B60K 37/06
2017/0174133 A1 6/2017 Kumon
2018/0068447 A1 3/2018 Prasad et al.
2020/0056417 A1* 2/2020 Lee ..... B60J 5/12
2020/0254928 A1* 8/2020 Monteiro ..... E05F 15/40

FOREIGN PATENT DOCUMENTS

DE 102012209048 A1 * 12/2013 ..... E05F 15/73
JP 2010236329 A * 10/2010
JP 6004754 B2 10/2016

* cited by examiner

*Primary Examiner* — Hunter B Lonsberry
*Assistant Examiner* — Elizabeth Yang
(74) *Attorney, Agent, or Firm* — Frank Lollo; Bejin Bieneman PLC

(57) ABSTRACT

A computer includes a processor and a memory, the memory storing instructions executable by the processor to actuate a vehicle door to an opened position and to determine a height of an object on a vehicle roof based on a distance from a sensor on the door in the opened position to a top of the object.

20 Claims, 7 Drawing Sheets

ENHANCED OBJECT DETECTION

BACKGROUND

Vehicles can transport objects. The objects are often stowed in an interior of the vehicle, e.g., a trunk, a passenger cabin, etc. However, certain objects, such as bicycles, may be too large to store in the interior of the vehicle. Such objects can be attached to a vehicle roof, extending above a height of the vehicle.

DETAILED DESCRIPTION

Figure 1:
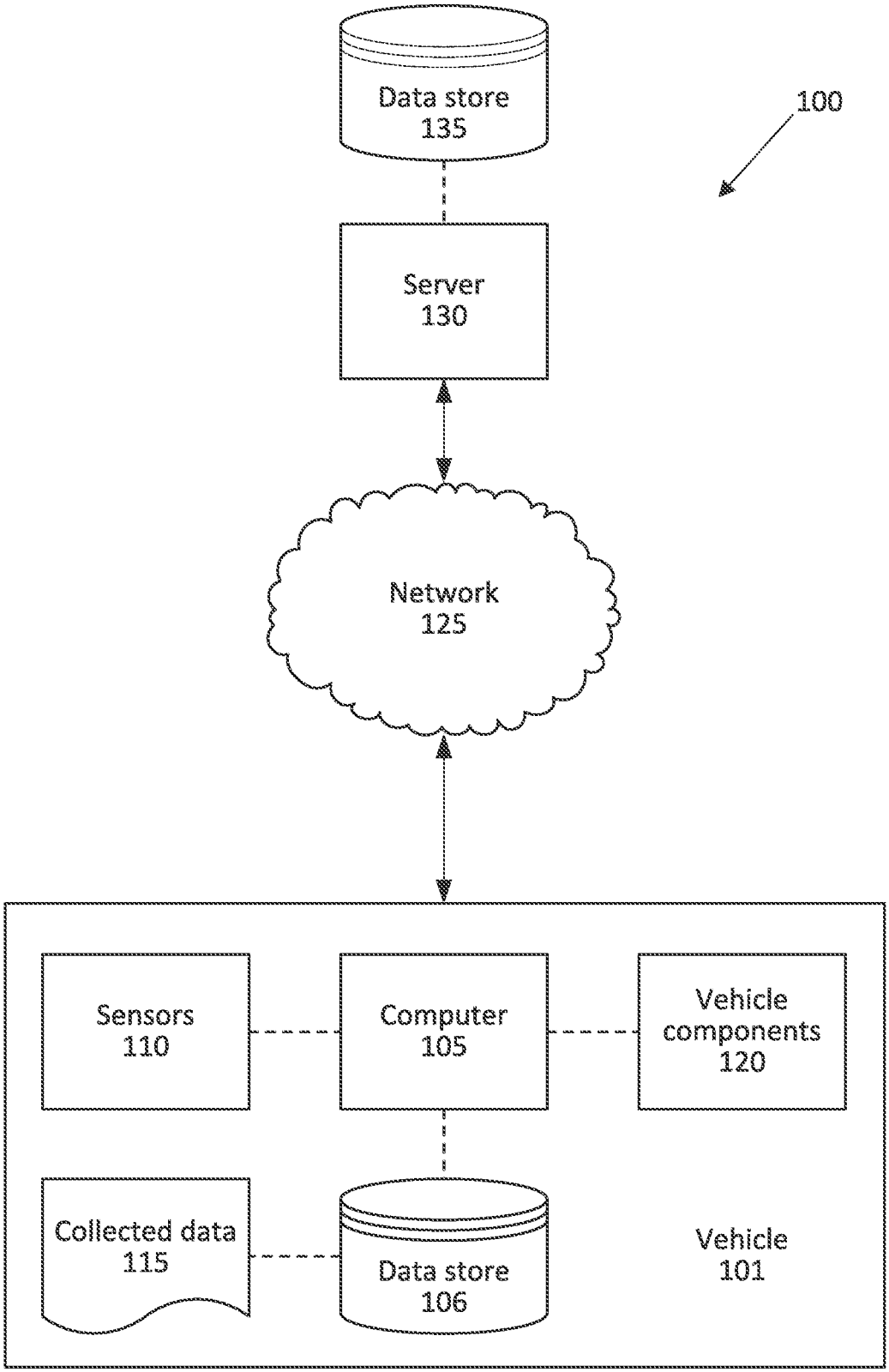
FIG. 1 is a block diagram of an example system for identifying a height of an object on a vehicle.

A system includes a vehicle roof, a vehicle door including a sensor, the vehicle door rotatably connected to the vehicle roof, and a computer including a processor and a memory, the memory storing instructions executable by the processor to actuate the vehicle door to an opened position and to determine a height of an object on the vehicle roof based on a distance from the sensor in the opened position to a top of the object.

The instructions can further include instructions to determine a sensor height of the sensor when the door is in the opened position and to determine the height of the object based on the sensor height.

The instructions can further include instructions to identify an obstacle height of an obstacle in front of a vehicle upon determining the height of the object and to identify a collision prediction when the height of the object exceeds the obstacle height.

The instructions can further include instructions to determine the height of the object based on a longitudinal distance between the sensor and the top of the object.

A system includes a computer including a processor and a memory, the memory storing instructions executable by the processor to actuate a vehicle door to an opened position and to determine a height of an object on a vehicle roof based on a distance from a sensor on the door in the opened position to a top of the object.

The instructions can further include instructions to determine a sensor height of the sensor when the door is in the opened position and to determine the height of the object based on the sensor height.

The instructions can further include instructions to determine a second sensor height of the sensor when the door is at an intermediate position between a closed position and the opened position and to determine the height of the object based on the sensor height and the second sensor height.

The intermediate position can be a position at which the sensor first detects the top of the object.

The instructions can further include instructions to determine a longitudinal distance between a first longitudinal position of the sensor at the intermediate position and a second longitudinal position of the sensor at the opened position and to determine the height of the object based on the longitudinal distance.

The instructions can further include instructions to determine a vertical distance between a vertical position of the sensor at the intermediate position and a second vertical position at the opened position and to determine the height of the object based on the vertical distance.

The instructions can further include instructions to, upon determining the height of the object, identify an obstacle height of an obstacle in front of a vehicle and to identify a collision prediction when the height of the object exceeds the obstacle height.

The instructions can further include instructions to, upon identifying the collision prediction, actuate a brake.

The instructions can further include instructions to determine the height of the object based on a longitudinal distance between the sensor and the top of the object.

The instructions can further include instructions to determine an angle between the sensor and the top of the object and to determine the height of the object based on the angle.

The instructions can further include instructions to determine a door angle between the door and an opening and to determine the height of the object based on the door angle.

The instructions can further include instructions to determine a field of view of the sensor and to determine the height of the object based on the field of view.

A method includes actuating a vehicle door to an opened position and determining a height of an object on a vehicle roof based on a distance from a sensor on the door in the opened position to a top of the object.

The method can further include determining a sensor height of the sensor when the door is in the opened position and determining the height of the object based on the sensor height.

The method can further include determining a second sensor height of the sensor when the door is at an intermediate position between a closed position and the opened position and determining the height of the object based on the sensor height and the second sensor height.

The method can further include determining a longitudinal distance between a first longitudinal position of the sensor at the intermediate position and a second longitudinal position of the sensor at the opened position and determining the height of the object based on the longitudinal distance.

The method can further include determining a vertical distance between a vertical position of the sensor at the intermediate position and a second vertical position at the opened position and determining the height of the object based on the vertical distance.

The method can further include, upon determining the height of the object, identifying an obstacle height of an obstacle in front of a vehicle and identifying a collision prediction when the height of the object exceeds the obstacle height.

The method can further include, upon identifying the collision prediction, actuating a brake.

The method can further include determining the height of the object based on a longitudinal distance between the sensor and the top of the object.

The method can further include determining an angle between the sensor and the top of the object and determining the height of the object based on the angle.

The method can further include determining a door angle between the door and an opening and determining the height of the object based on the door angle.

The method can further include determining a field of view of the sensor and determining the height of the object based on the field of view.

Further disclosed is a computing device programmed to execute any of the above method steps. Yet further disclosed is a vehicle comprising the computing device. Yet further disclosed is a computer program product, comprising a computer readable medium storing instructions executable by a computer processor, to execute any of the above method steps.

Determining the height of an object above the ground with a sensor in a door of a vehicle as disclosed herein typically utilizes existing vehicle sensors to quickly, efficiently, and accurately determine the overall height of the object and the vehicle, i.e., a height to which the object extends above the vehicle when mounted or transported atop the vehicle. By determining the overall height, a computer in the vehicle can determine whether the object will collide with an obstacle that has a height exceeding the vehicle height but below the object height. The sensor can have a field of view that can capture images of the object on the vehicle roof when the door is in an opened position. Because the computer previously determines the position of the sensor as the door opens to the opened position, the computer can quickly determine the height of the object based on the image data of the object.

FIG. 1 illustrates an example system 100 for identifying a height of an object on a vehicle 101. The system 100 includes a computer 105. The computer 105, typically included in a vehicle 101, is programmed to receive collected data 115 from one or more sensors 110. For example, vehicle 101 data 115 may include a location of the vehicle 101, data about an environment around a vehicle 101, data about an object outside the vehicle such as another vehicle, etc. A vehicle 101 location is typically provided in a conventional form, e.g., geo-coordinates such as latitude and longitude coordinates obtained via a navigation system that uses the Global Positioning System (GPS). Further examples of data 115 can include measurements of vehicle 101 systems and components, e.g., a vehicle 101 velocity, a vehicle 101 trajectory, etc.

The computer 105 is generally programmed for communications on a vehicle 101 network, e.g., including a conventional vehicle 101 communications bus. Via the network, bus, and/or other wired or wireless mechanisms (e.g., a wired or wireless local area network in the vehicle 101), the computer 105 may transmit messages to various devices in a vehicle 101 and/or receive messages from the various devices, e.g., controllers, actuators, sensors, etc., including sensors 110. Alternatively or additionally, in cases where the computer 105 actually comprises multiple devices, the vehicle network may be used for communications between devices represented as the computer 105 in this disclosure. In addition, the computer 105 may be programmed for communicating with the network 125, which, as described below, may include various wired and/or wireless networking technologies, e.g., cellular, Bluetooth®, Bluetooth® Low Energy (BLE), wired and/or wireless packet networks, etc.

The data store 106 can be of any type, e.g., hard disk drives, solid state drives, servers, or any volatile or non-volatile media. The data store 106 can store the collected data 115 sent from the sensors 110.

Sensors 110 can include a variety of devices. For example, various controllers in a vehicle 101 may operate as sensors 110 to provide data 115 via the vehicle 101 network or bus, e.g., data 115 relating to vehicle speed, acceleration, position, subsystem and/or component status, etc. Further, other sensors 110 could include cameras, motion detectors, etc., i.e., sensors 110 to provide data 115 for evaluating a position of a component, evaluating a slope of a roadway, etc. The sensors 110 could, without limitation, also include short range radar, long range radar, LIDAR, and/or ultrasonic transducers.

Collected data 115 can include a variety of data collected in a vehicle 101. Examples of collected data 115 are provided above, and moreover, data 115 are generally collected using one or more sensors 110, and may additionally include data calculated therefrom in the computer 105, and/or at the server 130. In general, collected data 115 may include any data that may be gathered by the sensors 110 and/or computed from such data.

The vehicle 101 can include a plurality of vehicle components 120. In this context, each vehicle component 120 includes one or more hardware components adapted to perform a mechanical function or operation—such as moving the vehicle 101, slowing or stopping the vehicle 101, steering the vehicle 101, etc. Non-limiting examples of components 120 include a propulsion component (that includes, e.g., an internal combustion engine and/or an electric motor, etc.), a transmission component, a steering component (e.g., that may include one or more of a steering wheel, a steering rack, etc.), a brake component (as described below), a park assist component, an adaptive cruise control component, an adaptive steering component, a movable seat, or the like.

When the computer 105 partially or fully operates the vehicle 101, the vehicle 101 is an "autonomous" vehicle 101. For purposes of this disclosure, the term "autonomous vehicle" is used to refer to a vehicle 101 operating in a fully autonomous mode. A fully autonomous mode is defined as one in which each of vehicle propulsion, braking, and steering are controlled by the computer 105. A semi-autonomous mode is one in which at least one of vehicle propulsion, braking, and steering are controlled at least partly by the computer 105 as opposed to a human operator. In a non-autonomous mode, i.e., a manual mode, the vehicle propulsion, braking, and steering are controlled by the human operator.

The system 100 can further include a network 125 connected to a server 130 and a data store 135. The computer 105 can further be programmed to communicate with one or more remote sites such as the server 130, via the network 125, such remote site possibly including a data store 135. The network 125 represents one or more mechanisms by which a vehicle computer 105 may communicate with a remote server 130. Accordingly, the network 125 can be one or more of various wired or wireless communication mechanisms, including any desired combination of wired (e.g., cable and fiber) and/or wireless (e.g., cellular, wireless, satellite, microwave, and radio frequency) communication mechanisms and any desired network topology (or topologies when multiple communication mechanisms are utilized). Exemplary communication networks include wireless communication networks (e.g., using Bluetooth®, Bluetooth® Low Energy (BLE), IEEE 802.11, vehicle-to-vehicle (V2V) such as Dedicated Short Range Communications (DSRC), etc.), local area networks (LAN) and/or wide area networks (WAN), including the Internet, providing data communication services.

Figure 2:
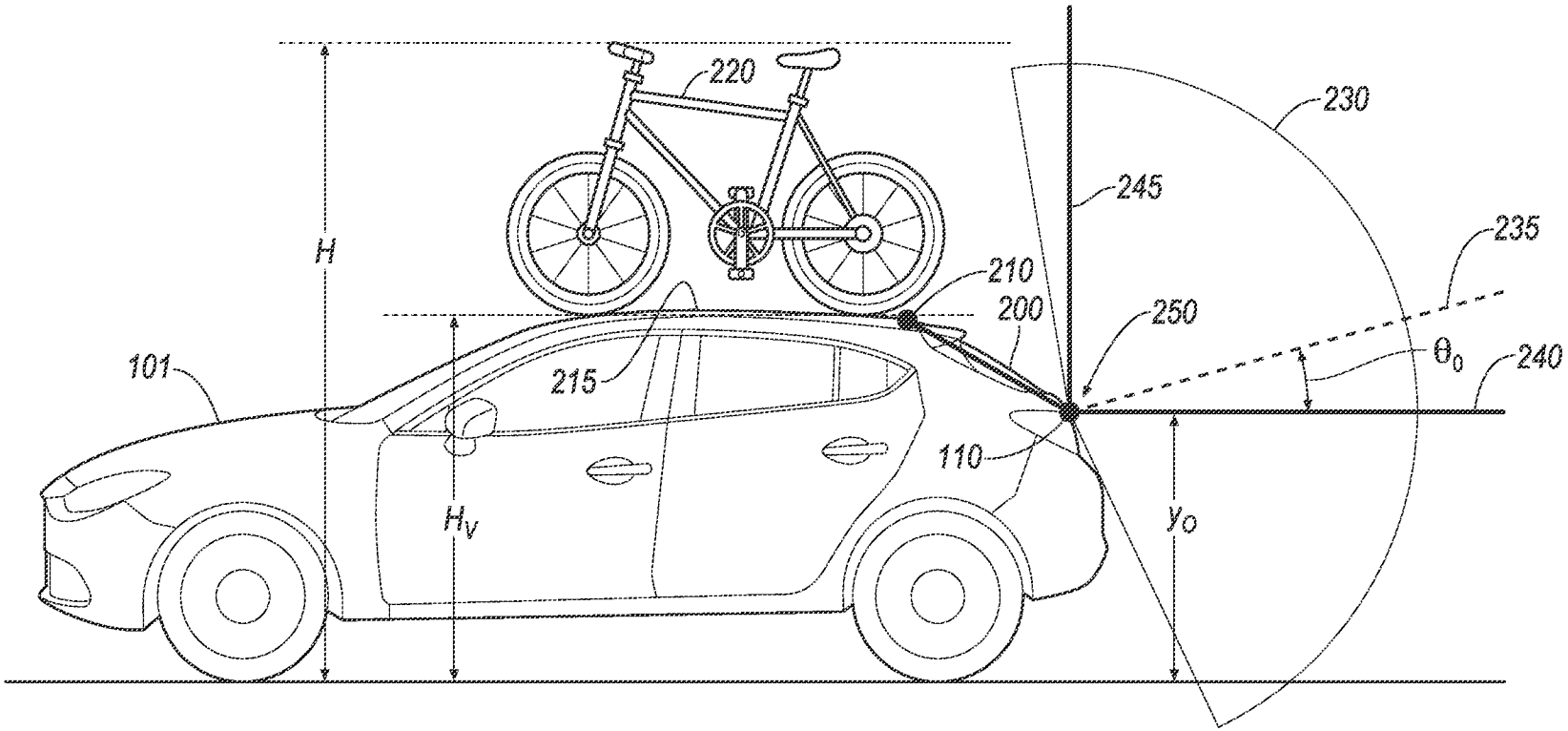
FIG. 2 is a side view of an example vehicle with a door in a closed position.

FIG. 2 is a side view of an example vehicle 101. The vehicle 101 includes a hinged cover for an opening (e.g., a window or door opening) such as a door 200. The door 200 is a movable door on a rear end of the vehicle 101 that in a closed position covers an opening 205, e.g., a rear hatch covering a hatch opening. Alternatively, the door 200 may be any movable door of the vehicle 101, e.g., a passenger door, a lambo vertical door, a bay door of a cargo van, a window, etc. The door 200 is connected to a body of the vehicle 101 via a hinge 210. The door 200 is rotatable about the hinge 210, e.g., with a motor, force applied by a human, force applied by a biasing element such as a spring or the like. The door 200 is movable from the closed position to an opened position. In this context, the "opened position," as shown in FIG. 4, is a position in which the door 200 cannot open farther, i.e., is maximally rotated away from the closed position. In the closed position, the sensor 110 is positioned at a start point 250. As the door 200 opens, the sensor 110 rotates around a circle having a radius extending from the hinge 210 to the start point 250. As described below with reference to FIGS. 3-4, the hinge 210 can rotate the door 200 to a door angle $\phi$ between a line extending from the hinge 210 to the sensor 110 and a line extending from the hinge 210 to the start point 250. Alternatively, the hinge 210 can include an angle sensor and the computer 105 can determine the door angle $\phi$ as the angle of rotation of the hinge 210 as detected by the angle sensor.

The vehicle 101 includes a roof 215. The roof 215 is an outermost and topmost portion of the vehicle 101. The roof 215 covers a passenger cabin of the vehicle 101. The roof 215 can include a rack (not shown) for securing objects.

An object 220 is mounted to the roof 215. The object 220 has a top 225, i.e., a point most distant from the ground in a vertical direction. When the object 220 is mounted to the roof 215, the top 225 of the object 220 can interfere with an obstacle (or vice-versa), as discussed further below. The object 220 can be, e.g., a bicycle, a motorcycle, a storage bin, etc.

The door 200 includes a sensor 110. The sensor 110 detects the object 220 on the roof 215. The sensors 110 can be, e.g., an image sensor, an infrared sensor, a radar, a LIDAR, etc. A sensor 110 can collect data 115 about the object 220, e.g., a location of the top 225 of the object 220. Based on data 115 collected about the object 220, the computer 105 can determine an object height H of the vehicle 101 with the object 220, as described below. The sensor 110 is a distance R from the hinge 210, and the distance R can be measured by, e.g., a manufacturer, and stored in the data store 106 and/or the server 130.

The sensor 110 has a field of view 230. The field of view 230 is a physical space or area in which the sensor 110 can collect data 115. In the example of FIG. 2, the field of view 230 is illustrated as a 2-dimensional area subtended by an arc of a circle having its center at the sensor 110; in this example, the field of view 230 can be defined as a 3-dimensional portion of a sphere having its center at the sensor 110 bounded by rotating the arc around an axis pointing out from the sensor 110. For example, the field of view 230 of the sensor 110 can be an area subtended by an arc of 170 degrees. The field of view 230 defines an angle range $\rho$, e.g., 170 degrees.

The field of view 230 has a central axis 235. The central axis 235 is a line extending from the sensor 110 that bisects the field of view 230. In the example of FIG. 2, the field of view 230 is thus defined as 85 degrees clockwise relative to the central axis 235 and 85 degrees counterclockwise relative to the central axis 235. Based on the central axis 235, the computer 105 can determine the position of objects detected in the field of view 230.

The computer 105 can store a definition of a longitudinal axis 240. The longitudinal axis 240 is defined as an axis parallel to the ground having an origin at the sensor 110. The longitudinal axis 240 can be defined by an angle $\theta_0$ determined upon installation of the sensor 110 to the door 200. That is, the central axis 235 and the longitudinal axis 240 define the angle $\theta_0$, and the angle $\theta_0$ can be determined by, e.g., a vehicle 101 manufacturer, and stored in the data store 106 and/or the server 130.

The computer 105 can store a definition of a vertical axis 245. The vertical axis 245 is defined as an axis perpendicular to the longitudinal axis 240 and pointing in a vertical direction, i.e., opposite the direction of gravity. The longitudinal axis 240 and the vertical axis 245 are defined relative to the vehicle 101, i.e., the axes 240, 245 do not change even as the door 200 rotates to the open position. As the door 200 rotates to the open position, the sensor 110 and the central axis 235 rotate. Thus, the longitudinal axis 240 and the vertical axis 245, which are global axes fixed relative to the vehicle 101, change relative to the central axis 235, which is defined relative to the moving sensor 110. Because the axes 240, 245 have their respective origins at the sensor 110, when the door 200 opens and moves the sensor 110 relative to the rest of the vehicle 101, the field of view 230 rotates with the sensor 110 while the axes 240, 245 remain in their respective longitudinal and vertical directions. The computer 105 can determine the axes 240, 245 in the moving reference frame defined by the field of view 230 and the moving central axis 235. The angle $\theta$ between the central axis 235 and the longitudinal axis 240 changes, and previous definitions of the longitudinal axis 240 and the vertical axis 245 are no longer accurate as door 200 opens. As the sensor 110 moves and the central axis 235 rotates, the computer 105 can update the longitudinal axis 240 in the longitudinal direction relative to the central axis 235 and the vertical axis 245 in the vertical direction relative to the central axis 235.

A vehicle height $H_v$, i.e., a vertical distance above the ground of the vehicle 101, e.g., measured or specified by a manufacturer and stored in the data store 106 and/or the server 130. The object 220 has an object height H, i.e., a vertical distance of the top 225 of the object 220 above the ground. Based on the object height H, the computer 105 can determine whether the object 200 will collide with an obstacle, as described below.

Figure 3:
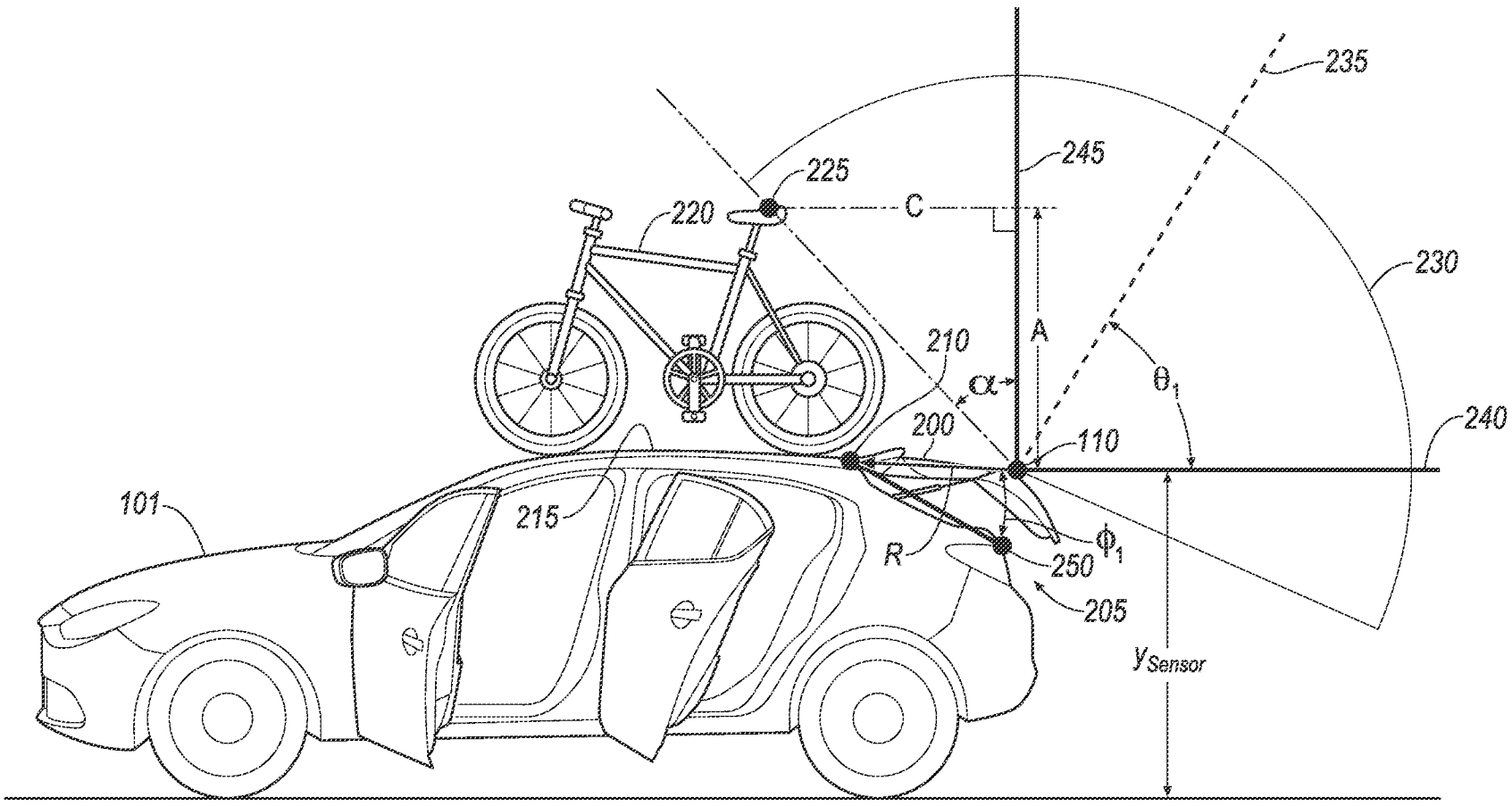
FIG. 3 is a side view of the example vehicle with the door in an intermediate position.
Figure 4:
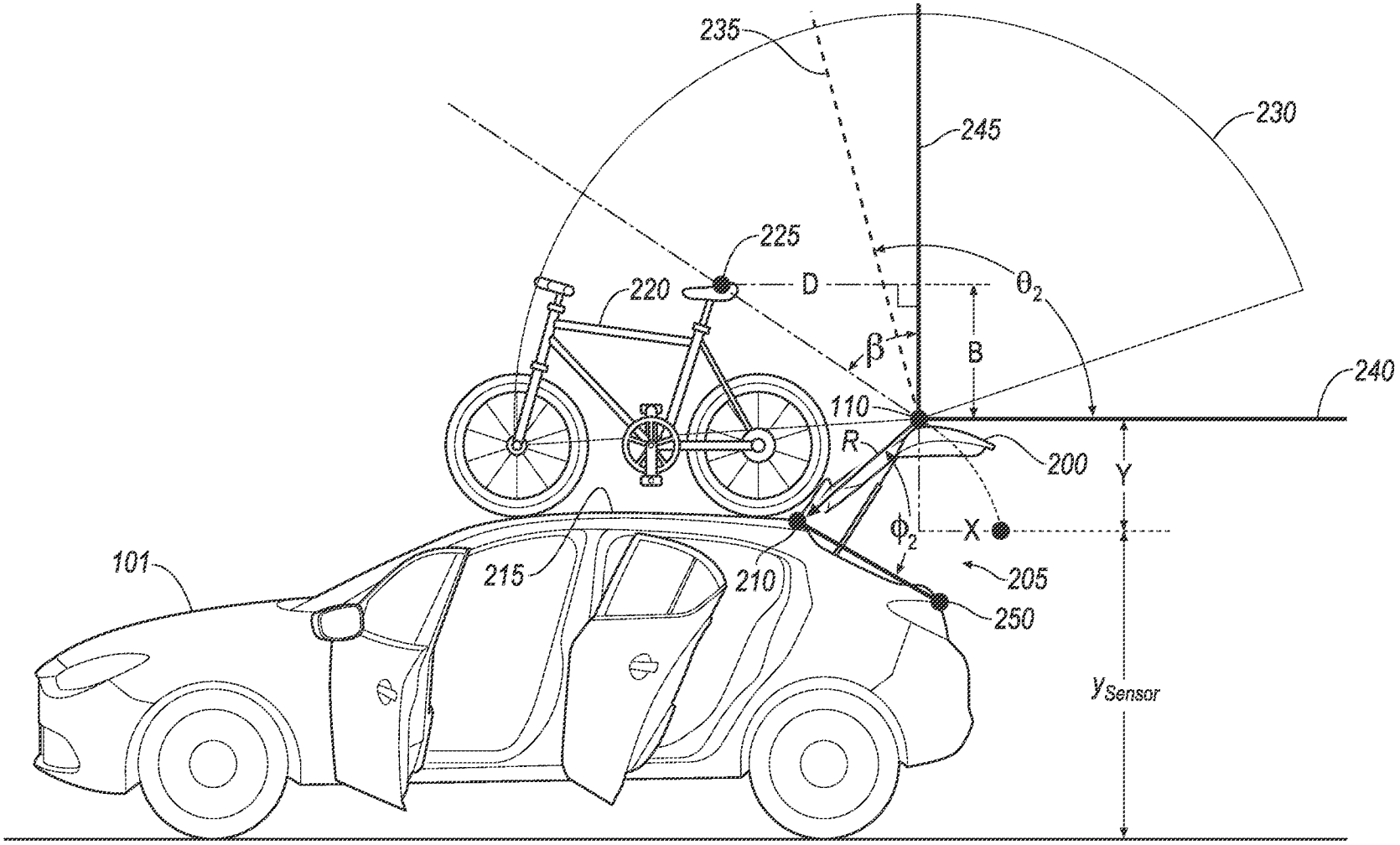
FIG. 4 is a side view of the example vehicle with the door in an opened position.

FIG. 3 is a view of the door 200 in an intermediate position. The intermediate position is a position between the closed position, as shown in FIG. 2, and the opened position, as shown in FIG. 4. In FIG. 3, the intermediate position is a position at which the sensor 110 first detects the top 225, i.e., uppermost point or points, of the object 220. The sensor 110 can, based on data 115 of the object 220, determine a topmost (or uppermost) point of the object 220 in the image data 115. The computer 105 can determine the topmost point in the image data 115 as the top 225 of the object 220. If the sensor 110 collects additional image data 115 and identifies another portion of the object 220 at greater vertical coordinates in the images 115 than the previously identified top 225, the computer 105 can determine that the newly identified portion of the object 220 is the top 225. Thus, the computer 105 determines the top 225 as the portion of the object 220 at the greatest vertical position in the image data 115, and the intermediate position is a door angle $\phi_1$ between a line extending from the hinge 210 to the sensor 110 and a line extending from the hinge 210 to the end 250 at which the sensor 110 first detects the top 225 of the object 220.

The central axis 235 defines an angle $\theta_1$ with the longitudinal axis 240 in the intermediate position. As the door 200 rotates to the intermediate position, the sensor 110 follows an arcuate path defined by the angle of rotation of the door 200. The computer 105 can determine the angle $\theta_1$ based on the door angle $\phi_1$ of the door 200 and the angle $\theta_0$ defined when the door 200 was in the closed position, i.e., $\theta_1=\theta_0+\phi_1$.

The computer 105 can determine a sensor height $y_{sensor}$ of the sensor 110. The "sensor height" is a vertical distance of the sensor 110 from the ground. The computer 105 can determine the sensor height $y_{sensor}$ based on an initial sensor height $y_0$ when the door 200 is in the closed position and the door angle $\phi_1$:

$$y_{sensor}=y_0+R\sin(\phi_1) \tag{1}$$

The vertical axis 245 defines an angle $\alpha$ with the top 225 of the object 220. The angle $\alpha$ is the portion of the angle range $\rho$ of the field of view 230 to the counterclockwise relative to the vertical axis 245, and can be determined based on the angle $\theta_1$:

$$\alpha=\frac{\rho}{2}+\theta_1-90 \tag{2}$$

FIG. 4 is a view of the door 200 in an opened position. As described above, the opened position is the farthest position that the door 200 is designed to open. Upon actuating the door 200 to the opened position, the door 200 halts, i.e., stops rotation at the open position. The opened position defines a door angle $\phi_2$ between a line extending from the hinge 210 to the sensor 110 and a line extending from the hinge 210 to the start point 250.

The computer 105 can identify a sensor height of the sensor 110 in the opened position. The computer 105 can determine the sensor height based on the door angle $\phi_2$:

$$y_{sensor,opened}=y_0+R\sin(\phi_2) \tag{3}$$

The central axis 235 defines an angle $\theta_2$ with the longitudinal axis 240 in the opened position. The computer 105 can determine the angle $\theta_2$ based on the door angle $\phi_2$ of the door 200 and the angle $\theta_0$ defined when the door 200 was in the closed position, i.e., $\theta_2=\theta_0+\phi_2$.

An angle $\beta$ is defined between the vertical axis 245 and a line extending between the sensor 110 and the top 225 of the object 220. That is, the angle $\beta$ is the portion of the angle range $\rho$ of the field of view 230 counterclockwise relative to the vertical axis 245, and can be determined based on the angle $\theta_2$ and the door angles $\phi_2$, $\phi_1$:

$$\beta=\frac{\rho}{2}+\theta_2-90-(\phi_2-\phi_1) \tag{4}$$

Figure 5:
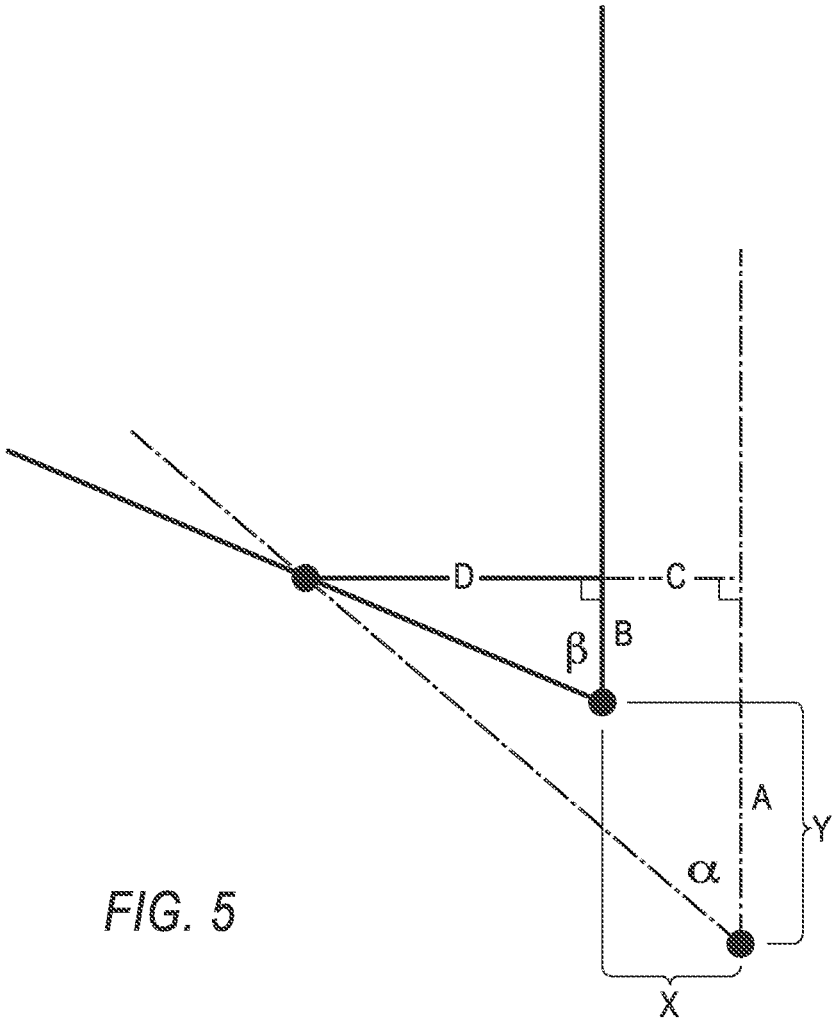
FIG. 5 is a diagram illustrating distances between a sensor and an object.

FIG. 5 is a diagram of the height of the sensor 110 and the top 225 of the object 220. Based on the position of the sensor 110 at the intermediate position and the opened position, the computer 105 can determine the height of the object 220. As illustrated, at the intermediate position, the angle $\alpha$ can be defined between the vertical axis 245 and a line extending from the sensor 110 to the top 225 of the object 220. Further, a vertical distance A between the sensor 110 and the top 225 of the object 220, and a longitudinal distance C between the sensor 110 and the top 225 of the object 220, can be defined. At the open position, the sensor 110 defines the angle $\beta$ between the vertical axis 245 and a line extending from the sensor 110 to the top 225 of the object 220, a vertical distance B between the sensor 110 and the top 225 of the object 220, and a longitudinal distance D between the sensor 110 and the top 225 of the object 220. Because the height of the sensor 110 when the door 200 is in the opened position is determined based on the door angle $\phi_2$, the computer 105 can determine the object height H by determining the vertical distance B.

The computer 105 can determine a relative longitudinal change X and a relative vertical change Y of the position of the sensor 110 between the intermediate position and the opened position. The relative longitudinal change X is a longitudinal distance between a first longitudinal position of the sensor 110 in the intermediate position and a second longitudinal position of the sensor 110 in the opened position. The relative vertical change Y is a vertical distance between a first vertical position of the sensor 110 in the intermediate position and a second vertical position of the sensor 110 in the opened position.

Because the distance from the sensor 110 to the hinge 210, R, is known, the computer 105 can determine the change in door angle $\Delta\phi$ of the door 200 between the door angle $\phi_1$ defining the intermediate position and the door angle $\phi_2$ defining the opened position. Based on the change in door angle $\Delta\phi=\phi_2-\phi_1$, the computer 105 can, using conventional geometric techniques, determine X and Y:

$$X=R(1-\cos(\Delta\phi)) \tag{5}$$

$$Y=R\sin(\Delta\phi) \tag{6}$$

The distances A, B, C, D can be represented in terms of known parameters X, Y, $\alpha$, $\beta$:

$$\tan(\alpha)=\frac{C}{A} \tag{7}$$

$$\tan(\beta)=\frac{D}{B} \tag{8}$$

$$B+Y=A \tag{9}$$

$$D+X=C \tag{10}$$

These equations can be rearranged to solve for B:

$$B=\frac{X-Y\tan(\alpha)}{\tan(\alpha)-\tan(\beta)} \tag{11}$$

The parameters A, C, D can be determined based on the value for B in the above equations. For example, D=B tan($\beta$) and A=B+Y, and upon determining D, C=D+X. The computer 105 can determine the object height H based on the sensor height when the door 200 is in the opened position and the parameter B:

$$H=y_0+R\sin(\phi_2)+B \tag{12}$$

Figure 6:
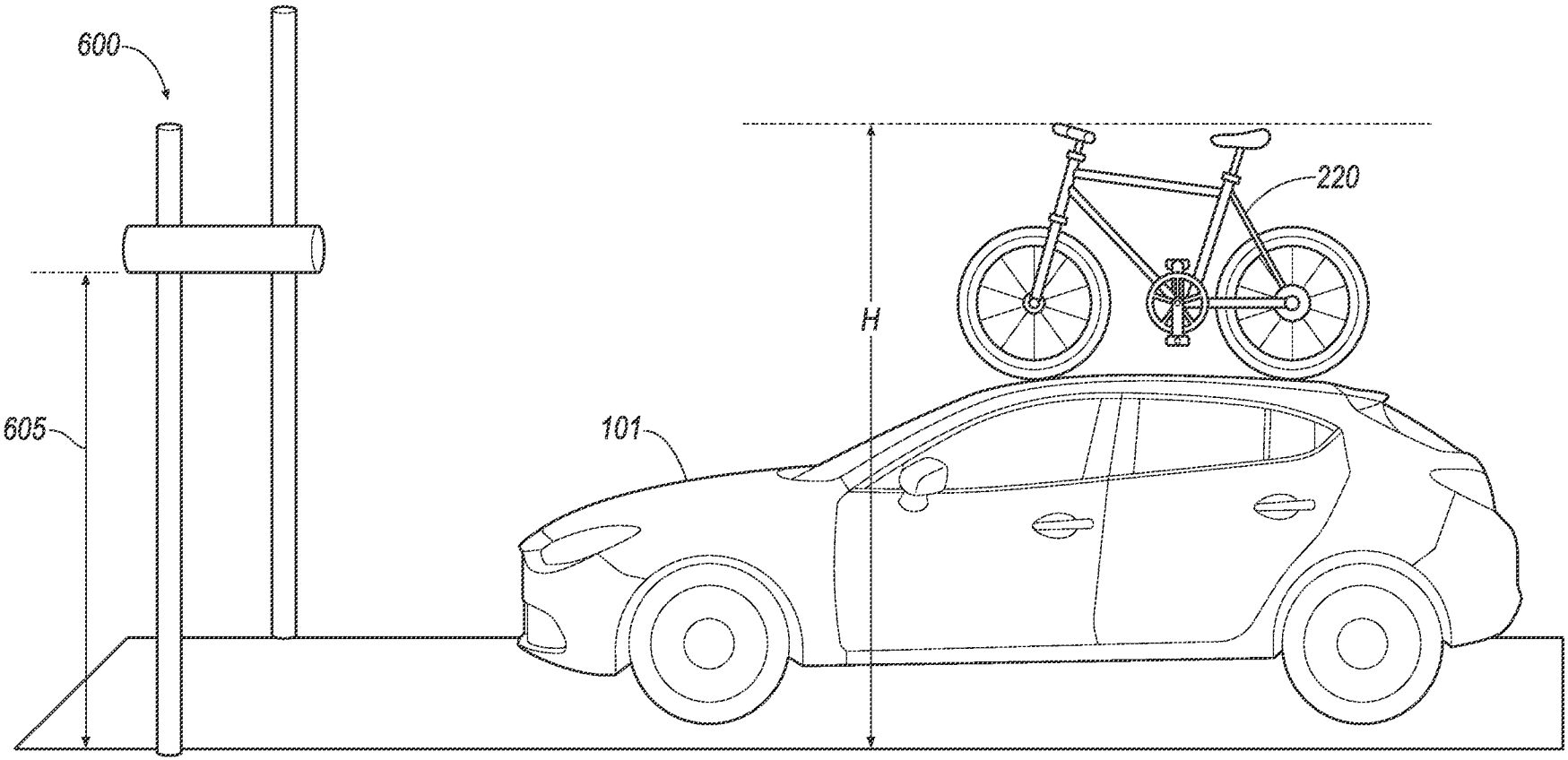
FIG. 6 is a side view of the example vehicle and an example obstacle.

FIG. 6 is a view of an example obstacle 600 in front of the vehicle 101. The obstacle 600 has an obstacle height 605. The obstacle 600 prevents vehicles 101 exceeding the obstacle height 605 from passing through the obstacle 600. The obstacle 600 can be, e.g., a parking garage entrance, a highway overpass, etc. The computer 105 can determine the obstacle height 605 based on, e.g., image data 115 of the obstacle 600 and conventional distance determining techniques, e.g., triangle similarity between successive images, comparison of pixel height of the obstacle 600 in an image to a reference image of a reference height, open CV calibration, etc.

Upon determining the object height H, the computer 105 can compare the obstacle height 605 to the object height H. If the obstacle height H is greater than the obstacle height 605, the object 220 will collide with the obstacle 600. To prevent a collision between the object 220 and the obstacle 600, if the object height H exceeds than the obstacle height 605, the computer 105 identifies a collision prediction. Upon identifying the collision prediction, the computer 105 can initiate one or more countermeasures to prevent a collision between the object 220 and the obstacle 600. For example, the computer 105 can actuate a brake to stop the vehicle 101 prior to reaching the obstacle 600. In another example, the computer 105 can provide an alert to a vehicle 101 user warning the user that the object height H exceeds the obstacle height 605.

Figure 7:
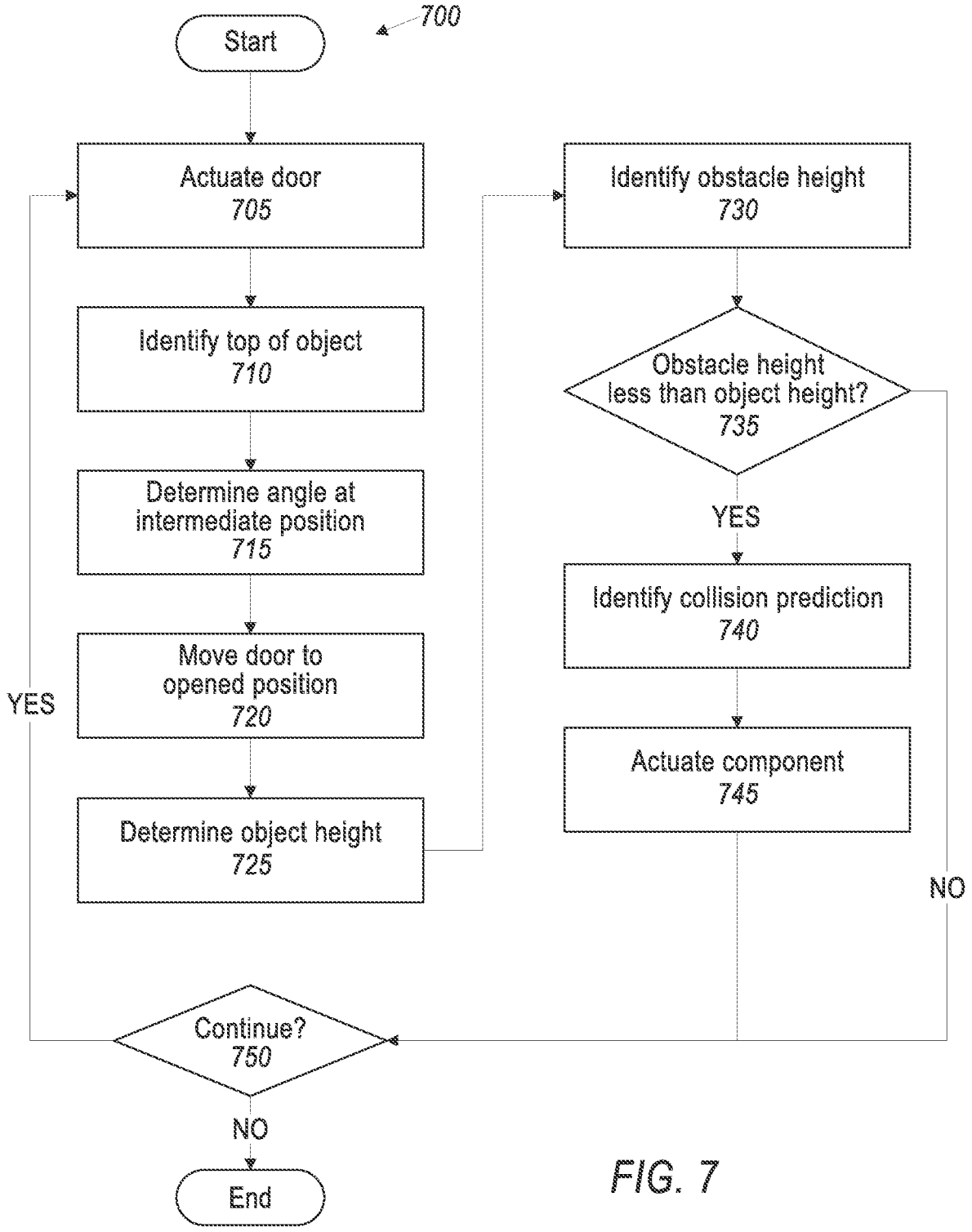
FIG. 7 is a block diagram of an example process for identifying a height of an object on a vehicle.

FIG. 7 illustrates an example process 700 for identifying a height of an object 220 mounted to a vehicle 101. The process 700 begins in a block 705, in which a computer 105 actuates a door 200 to open. As described above, the computer 105 can actuate a motor that moves the door 200 about a hinge 210.

Next, in a block 710, the computer 105 identifies a top 225 of the object 220. Upon receiving image data 115 from a sensor 110, the computer 105 can, e.g., using conventional image processing techniques, identify a vertical-most point of the object 220 as the top 225 of the object 220.

Next, in a block 715, the computer 105 determines a door angle $\phi_1$ when the computer 105 identifies the top 225 of the object 220 as an intermediate position. As described above, the door angle $\phi_1$ is an angle defined between a line extending from the hinge 210 to the sensor 110 and a line extending from the hinge 210 to the start point 250. The intermediate position is a first position at which the sensor 110 detects the top 225 of the object 220.

Next, in a block 720, the computer 105 moves the door 200 to the open position. As described above, the opened position is the farthest that the door 200 can rotate from the closed position. In the open position, the door 200 defines a second door angle $\phi_2$ between a line extending from the hinge 210 to the sensor 110 and a line extending from the hinge 210 to the start point 250.

Next, in a block 725, the computer 105 determines an object height H between the ground and the top 225 of the object 220. As described above, based on a second door angle $\phi_2$, the computer 105 can determine a relative longitudinal distance X of the sensor 110 between the intermediate position and the open position, a relative vertical distance Y of the sensor 110 between the intermediate position and the open position, an angle $\alpha$ between a vertical axis 240 and a line from the sensor 110 to the top 225 of the object 220 in the intermediate position, and an angle $\beta$ between the vertical axis 240 and a line extending from the sensor 110 to the top 225 of the object 220 in the opened position.

Next, in a block 730, the computer 105 identifies an obstacle 600 in front of the vehicle 101 and an obstacle height 605. As described above, the computer 105 can use conventional image processing techniques to determine the obstacle height 605. The obstacle 600 can be, e.g., a parking garage entrance, a highway overpass, etc.

Next, in a block 735, the computer 105 determines whether the obstacle height 605 is less than the object height H. If the obstacle height 605 is less than the object height H, the object 220 may collide with the obstacle 600 and the process 700 continues in a block 740. Otherwise, the process 700 continues in a block 750.

In the block 740, the computer 105 identifies a collision prediction. As described above, the collision prediction indicates that the object 220 extends above the obstacle height 605 and is likely to collide with the obstacle 600.

Next, in a block 745, the computer 105 actuates a component 120 to avoid and/or mitigate a collision. For example, the computer 105 can actuate a brake 120 to stop the vehicle 101 prior to the obstacle 600. In another example, the computer 105 can provide an alert to a vehicle 101 user to stop the vehicle 101 prior to the obstacle 600.

In the block 750, the computer 105 determines whether to continue the process 700. For example, the computer 105 can determine not to continue the process 700 when the vehicle 101 is stationary and powered off. If the computer 105 determines to continue, the process 700 returns to the block 705. Otherwise, the process 700 ends.

As used herein, the adverb "substantially" modifying an adjective means that a shape, structure, measurement, value, calculation, etc. may deviate from an exact described geometry, distance, measurement, value, calculation, etc., because of imperfections in materials, machining, manufacturing, data collector measurements, computations, processing time, communications time, etc.

Computing devices discussed herein, including the computer 105 and server 130 include processors and memories, the memories generally each including instructions executable by one or more computing devices such as those identified above, and for carrying out blocks or steps of processes described above. Computer executable instructions may be compiled or interpreted from computer programs created using a variety of programming languages and/or technologies, including, without limitation, and either alone or in combination, Java™, C, C++, Visual Basic, Java Script, Perl, HTML, etc. In general, a processor (e.g., a microprocessor) receives instructions, e.g., from a memory, a computer readable medium, etc., and executes these instructions, thereby performing one or more processes, including one or more of the processes described herein. Such instructions and other data may be stored and transmitted using a variety of computer readable media. A file in the computer 105 is generally a collection of data stored on a computer readable medium, such as a storage medium, a random access memory, etc.

A computer readable medium includes any medium that participates in providing data (e.g., instructions), which may be read by a computer. Such a medium may take many forms, including, but not limited to, non volatile media, volatile media, etc. Non volatile media include, for example, optical or magnetic disks and other persistent memory. Volatile media include dynamic random access memory (DRAM), which typically constitutes a main memory. Common forms of computer readable media include, for example, a floppy disk, a flexible disk, hard disk, magnetic tape, any other magnetic medium, a CD ROM, DVD, any other optical medium, punch cards, paper tape, any other physical medium with patterns of holes, a RAM, a PROM, an EPROM, a FLASH EEPROM, any other memory chip or cartridge, or any other medium from which a computer can read.

With regard to the media, processes, systems, methods, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. For example, in the process 700, one or more of the steps could be omitted, or the steps could be executed in a different order than shown in FIG. 7. In other words, the descriptions of systems and/or processes herein are provided for the purpose of illustrating certain embodiments, and should in no way be construed so as to limit the disclosed subject matter.

Accordingly, it is to be understood that the present disclosure, including the above description and the accompanying figures and below claims, is intended to be illustrative and not restrictive. Many embodiments and applications other than the examples provided would be apparent to those of skill in the art upon reading the above description. The scope of the invention should be determined, not with reference to the above description, but should instead be determined with reference to claims appended hereto and/or included in a non provisional patent application based hereon, along with the full scope of equivalents to which such claims are entitled. It is anticipated and intended that future developments will occur in the arts discussed herein, and that the disclosed systems and methods will be incorporated into such future embodiments. In sum, it should be understood that the disclosed subject matter is capable of modification and variation.

The article "a" modifying a noun should be understood as meaning one or more unless stated otherwise, or context requires otherwise. The phrase "based on" encompasses being partly or entirely based on.

What is claimed is:

1. A system, comprising:

a vehicle roof;

a vehicle door including a sensor, the vehicle door rotatably connected to the vehicle roof; and a computer including a processor and a memory, the memory storing instructions executable by the processor to:

actuate the vehicle door to an opened position;

collect image data of an object on a vehicle roof with a sensor disposed on the vehicle door; and determine a height of the object based on a distance from the sensor in the opened position to a top of the object and the collected image data.

2. The system of claim 1, wherein the instructions further include instructions to determine a sensor height of the sensor when the door is in the opened position and to determine the height of the object based on the sensor height.

3. The system of claim 1, wherein the instructions further include instructions to identify an obstacle height of an obstacle in front of a vehicle upon determining the height of the object and to identify a collision prediction when the height of the object exceeds the obstacle height.

4. The system of claim 1, wherein the instructions further include instructions to determine the height of the object based on a longitudinal distance between the sensor and the top of the object.

5. A system, comprising a computer including a processor and a memory, the memory storing instructions executable by the processor to:

actuate a vehicle door to an opened position;

collect image data of an object on a vehicle roof with a sensor disposed on the vehicle door; and determine a height of the object based on a distance from the sensor on the door in the opened position to a top of the object and the collected image data.

6. The system of claim 5, wherein the instructions further include instructions to determine a sensor height of the sensor when the door is in the opened position and to determine the height of the object based on the sensor height.

7. The system of claim 6, wherein the instructions further include instructions to determine a second sensor height of the sensor when the door is at an intermediate position between a closed position and the opened position and to determine the height of the object based on the sensor height and the second sensor height.

8. The system of claim 7, wherein the intermediate position is a position at which the sensor first detects the top of the object.

9. The system of claim 7, wherein the instructions further include instructions to determine a longitudinal distance between a first longitudinal position of the sensor at the intermediate position and a second longitudinal position of the sensor at the opened position and to determine the height of the object based on the longitudinal distance.

10. The system of claim 7, wherein the instructions further include instructions to determine a vertical distance between a vertical position of the sensor at the intermediate position and a second vertical position at the opened position and to determine the height of the object based on the vertical distance.

11. The system of claim 5, wherein the instructions further include instructions to, upon determining the height of the object, identify an obstacle height of an obstacle in front of a vehicle and to identify a collision prediction when the height of the object exceeds the obstacle height.

12. The system of claim 11, wherein the instructions further include instructions to, upon identifying the collision prediction, actuate a brake.

13. The system of claim 5, wherein the instructions further include instructions to determine the height of the object based on a longitudinal distance between the sensor and the top of the object.

14. The system of claim 5, wherein the instructions further include instructions to determine an angle between the sensor and the top of the object and to determine the height of the object based on the angle.

15. The system of claim 5, wherein the instructions further include instructions to determine a door angle between the door and an opening and to determine the height of the object based on the door angle.

16. The system of claim 5, wherein the instructions further include instructions to determine a field of view of the sensor and to determine the height of the object based on the field of view.

17. A method, comprising:

actuating a vehicle door to an opened position;

collecting image data of an object on a vehicle roof with a sensor disposed on the vehicle door; and determining a height of the object based on a distance from the sensor on the door in the opened position to a top of the object and the collected image data.

18. The method of claim 17, further comprising determining a sensor height of the sensor when the door is in the opened position and determining the height of the object based on the sensor height.

19. The method of claim 17, further comprising, upon determining the height of the object, identifying an obstacle height of an obstacle in front of a vehicle and identifying a collision prediction when the height of the object exceeds the obstacle height.

20. The method of claim 17, further comprising determining the height of the object based on a longitudinal distance between the sensor and the top of the object.

* * * * *